US005145280A

United States Patent [19]

Araki et al.

[11] Patent Number: 5,145,280

[45] Date of Patent: Sep. 8, 1992

[54] WATER DISASTER PREVENTION WATER CURTAIN FORMING APPARATUS

[75] Inventors: Toshimitsu Araki, Musashino; Fumihiko Kawamata, Chiba; Hitoshi Miyagawa, Kanagawa; Masahito Yoshida; Naotaka Masuda, both of Tokyo, all of Japan

[73] Assignees: Ishikawajima-Harima Heavy Industries Co., Ltd.; The Tokyo Electric Power Co., Inc., both of Tokyo, Japan

[21] Appl. No.: 668,805

[22] Filed: Mar. 7, 1991

Related U.S. Application Data

[63] Continuation of Ser. No. 358,237, May 26, 1989, abandoned.

[51] Int. Cl.[5] ..... E02B 15/04

[52] U.S. Cl. ..... 405/62; 405/60; 405/63

[58] Field of Search ..... 405/60, 62, 63, 73, 405/74, 52, 22

[56] References Cited

U.S. PATENT DOCUMENTS

| | | | |
|---|---|---|---|
| 1,716,616 | 6/1929 | Brasher | 405/22 |
| 3,593,526 | 7/1971 | Hoult | 405/62 |
| 3,665,713 | 5/1972 | Rath | 405/62 |
| 3,762,169 | 10/1973 | Graham | 405/62 |
| 4,059,962 | 11/1977 | Milgram | 405/72 |
| 4,325,826 | 4/1982 | Van Waveren et al. | 405/63 X |
| 4,348,059 | 9/1982 | Morgan | 405/61 |
| 4,356,094 | 10/1982 | Ross | 405/22 X |
| 4,571,125 | 2/1986 | Oshima et al. | 405/61 |

FOREIGN PATENT DOCUMENTS

| | | | |
|---|---|---|---|
| 0055622 | 5/1981 | Japan | 405/62 |
| 0830701 | 3/1960 | United Kingdom | 405/62 |

*Primary Examiner*—Dennis L. Taylor
*Attorney, Agent, or Firm*—Dykema Gossett

[57] ABSTRACT

A disaster prevention apparatus is adapted to intercept and disperse gas leaking from a disaster ship offshore. The apparatus includes a marine mover and a water curtain forming device for forming a water curtain on the lee of the disaster ship. Pressurized water is supplied to the water curtain forming device by a water pump. The water thusly supplied is ejected from the water curtain forming device in a direction substantially perpendicular to the water surface, thereby creating a water curtain on the water.

11 Claims, 8 Drawing Sheets

FIG. 5
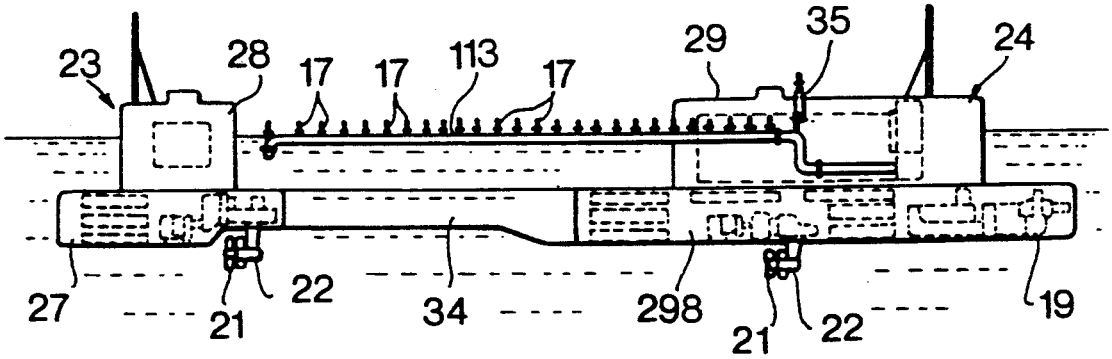
FIG. 6
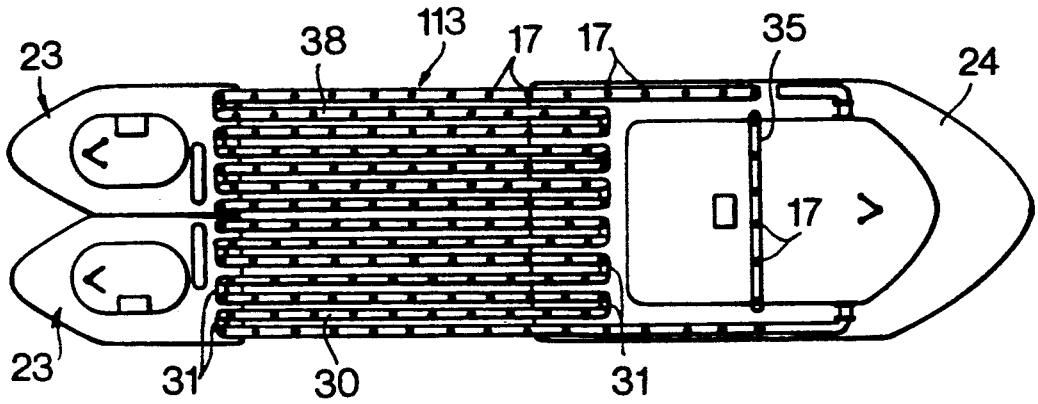
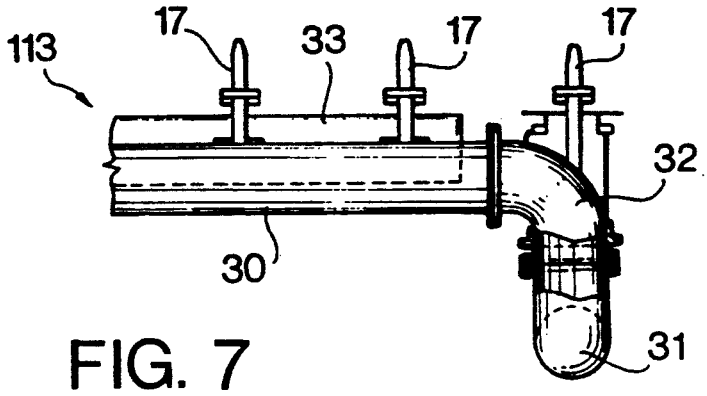
FIG. 7

FIG. 10
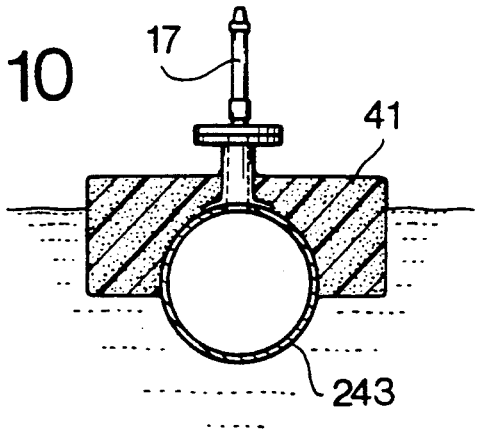
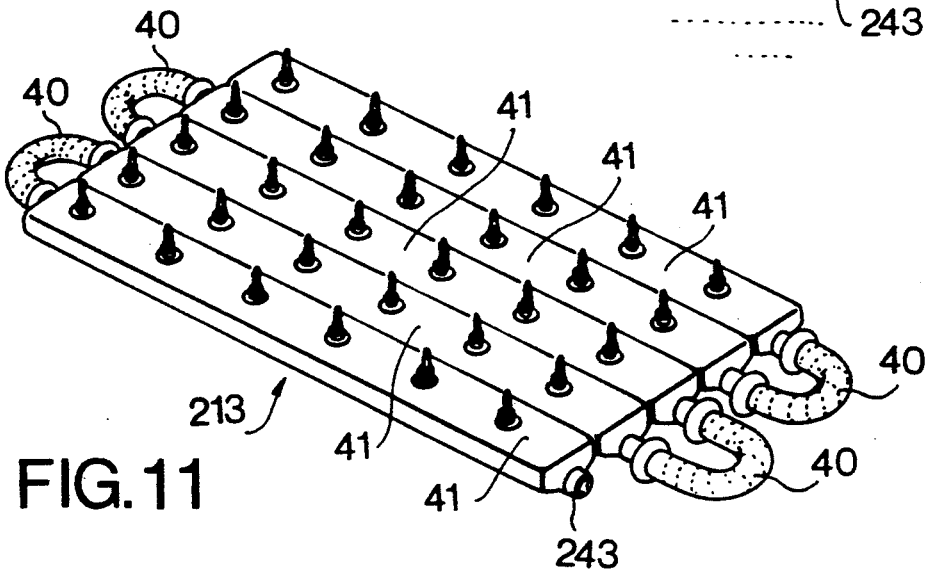
FIG. 11
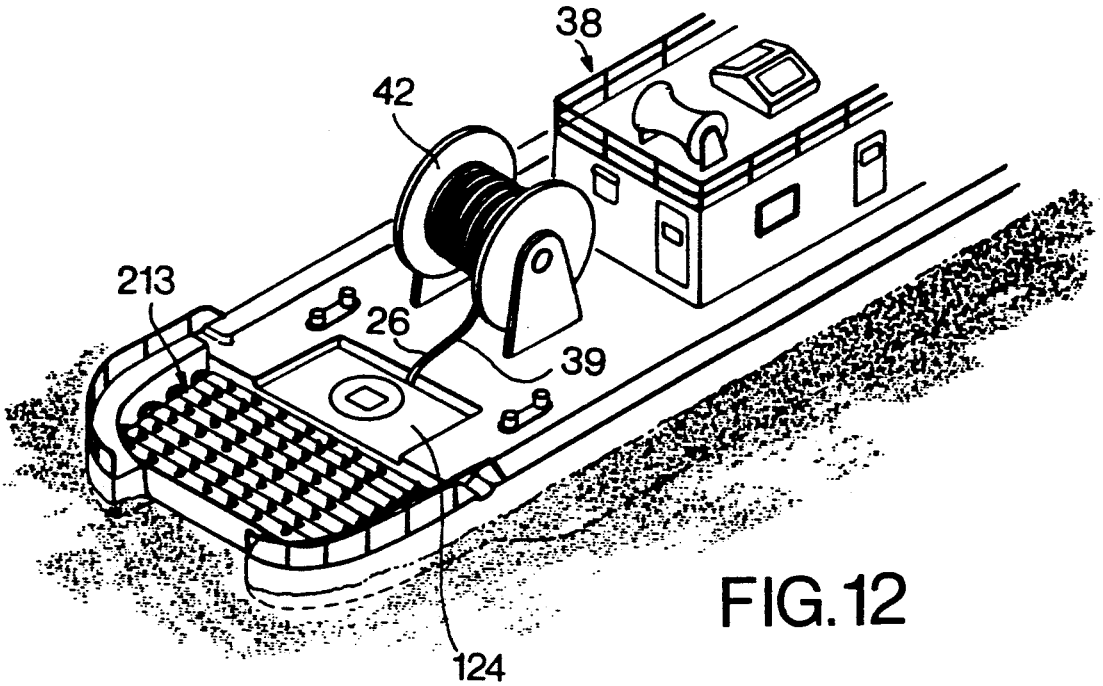
FIG. 12

WATER DISASTER PREVENTION WATER CURTAIN FORMING APPARATUS

This is a continuation of copending application(s) Ser. No. 07/358,237 filed on May 26, 1989 now abandoned.

BACKGROUND OF THE INVENTION

1. Technical Field

The present invention relates to a water curtain forming apparatus for forming around a ship which leaks dangerous gas a water disaster prevention curtain that blocks and disperses both the gas leaking from the ship or any flames resulting from the leakage.

2. Background Art

A large quantity of flammable gas, poisonous gas or the like is often transported by marine transportation. When a ship employed for such marine transportation suffers from an accident, such as a collision with another ship, a considerable mass of gas contained in the ship leaks into the sea. In a case where the leaking gas is flammable, a large region of the sea is rendered dangerous by a prospective explosion and fire. In a case where poisonous gas leaks, the environment is damaged, which may even result in human casualties. Particularly, if such accidents happen near land, some counter measures have to be taken promptly.

Several ideas have been suggested for preventing on-land disasters by stopping the gas diffusion or accelerating gas diffusion. For low-temperature storage tanks of LNG, for instance, a liquid stoppage bank is built around the tank, and a water injecting pipe is disposed along the top rim of the bank so as to form a water curtain. The water curtain helps the leakage disperse upward, whereby the gas ascends dispersing into the air, rather than crawling over ground. Here, it should be noted that such an accident prevention measure can be applied only to a complex on the ground. This means that it cannot be employed as a water accident prevention measure since the gas stoppage bank is stationary, whereas such water accidents occur anywhere, offshore or river, and the wind changes its direction frequently and quickly on the water. In short, the conventional on-land accident prevention system described above is not suited for an accident on water due to considerations of movability, size, expense and serviceability.

It has been strongly desired under the above-mentioned circumstances to propose a water curtain forming apparatus which is movable on the water and is capable of creating a disaster prevention water curtain of a size which is sufficient to cover the accident zone.

SUMMARY OF THE INVENTION

A first object of the present invention is to provide a disaster prevention system using a water screen that is rapidly movable or transportable to a specified place at which a gas-carrying tanker is leaking gas. The water screen intercepts and disperses the gas flowing from the tanker in order to prevent freezing of the water from spreading, if the leakage is low-temperature gas, or to reduce radiant heat if the leakage is hot gas. The water screen disaster prevention system includes a body movable on the water surface, an aquatic disaster prevention curtain forming means disposed in the body for forming a water curtain perpendicular to the water surface by injecting water upward, so as to intercept the leakage gas flowing out of a gas tanker and to promote dispersion of the leakage in the vertical direction, but not in the horizontal direction, and a pressurized water supply means for continuously supplying the pressurized water to the water curtain forming means. The body travels on the water to the place of the disaster. Then, the water supply means supplies pressurized water to the water curtain forming device, so that the disaster prevention water curtain extending substantially vertically on the water surface is built, and therefore the leakage gas is blocked and dispersed upward. If low-temperature gas, such as LNG, leaks onto the water, the water is frozen since the temperature of the leakage is about −150° C. or lower. If flammable gas leaks, fire may occur. If the spill is poisonous gas, living sea habitat will be damaged. The water curtain prevents the leaking gas from crawling on the water surface in high concentration by dispersing the gas upward. When high-temperature gas leaks or a fire occurs, the water curtain absorbs the radiant heat therefrom.

A second object of the present invention is to provide a disaster prevention system forming a single sheet of water curtain using a plurality of watercrafts independent from each other in addition to the first object mentioned above. To attain this objective, the disaster prevention system includes a plurality of watercraft to be positioned at certain intervals near the accident spot; water curtain forming devices respectively installed on the watercrafts for forming a water curtain substantially perpendicular to the water surface by ejecting water upward, so as to prevent the leaking gas from diffusing in a horizontal direction from the accident spot; and a water supply means for continuously supplying the pressurized water to the water curtain forming means. The watercrafts are directed to the accident spot and positioned at intervals. Then, the water supply means supplies pressurized water to the water curtain forming devices, so that a plurality of water curtains extending vertically on the water surface are created. These curtains are formed in a manner such that they define a single curtain. Thereupon, the leakage gas is blocked in its horizontal movement and dispersed in the vertical direction.

A third object of the present invention is to provide a disaster prevention system for forming a single water curtain defined by plural water curtains with the use of a plurality of inexpensive floatable elements in addition to the object mentioned above. To attain this objective, the disaster prevention system includes a plurality of floatable elements to be positioned at certain intervals near the accident spot; water curtain forming devices respectively installed on the floatable elements for forming a water curtain perpendicular to the water surface by injecting water upward, so as to prevent the leakage gas from horizontally diffusing from the accident spot; and a water supply means for continuously supplying the pressurized water to the water curtain forming means. The floatable elements are directed to the accident spot and positioned at intervals. Then, the water supply means supplies pressurized water to the water curtain forming devices, so that a plurality of water curtains extending vertically on the water surface are created. These curtains are formed in a manner such that they define a single curtain. Thereupon, the leakage gas is blocked in its horizontal movement and dispersed in the vertical direction.

A fourth object of the present invention is to provide a disaster prevention system which is easy to carry and to set in addition to the third object mentioned above.

To attain this objective, the disaster prevention system includes a group of floatable members to be carried on a vessel and to be aligned near the accident zone; water curtain forming devices for forming a water curtain perpendicular to the water surface along a line in which the floatable members are aligned by injecting water, so as to intercept the leakage gas while diffusing the same upward; and a water supply means for continuously supplying the pressurized water to the water curtain forming means. The group of floatable members are carried on the vessel to the accident spot. Then, the water supply means supplies pressurized water to the water curtain forming devices, so that a water curtain extending vertically on the water surface is produced. The curtain thusly formed stops and disperses the spill from the accident spot.

A fifth object of the present invention is to provide a disaster prevention water curtain forming system which is easy to adjust in positioning, and in turn which can easily create various forms of a water curtain. To attain this purpose, the disaster prevention system includes a plurality of floatable members to be aligned near the accident zone; water curtain forming devices for forming a water curtain perpendicular to the water surface along a line in which the floatable members are aligned, so as to intercept the leakage gas from flowing out of the accident zone while diffusing the same; water supply means for continuously supplying the pressurized water to the water curtain forming means; and transportation means respectively provided to the floatable members at the front and rear sides thereof for respectively moving the floatable members right and left, as well as back and forth. As the water supply means supplies pressurized water to the water curtain forming devices, a water curtain extending vertically on the water surface is produced. Here, each transportation means can change the position of each floatable member independently from other floatable members, so that it is possible to create various shapes of a water screen in accordance with given conditions, such as the configuration of the accident zone and wind direction. Such water curtains are able to effectively block and disperse the dangerous gas running out of the accident zone.

BRIEF DESCRIPTION OF THE DRAWINGS

FIG. 5 is a side view showing the floatable member;

FIG. 6 is a top view showing the floatable members as they are folded;

FIG. 7 is a fragmentary enlarged view of a joint which rotatably connects two pipe members;

FIG. 10 is a sectional view taken along line X—X of FIG. 9;

FIG. 11 is a perspective view depicting the floatable members as they are folded;

FIG. 12 is a perspective view depicting the floatable member folded and stored in a vessel;

DESCRIPTION OF THE PREFERRED EMBODIMENTS

Figure 1:
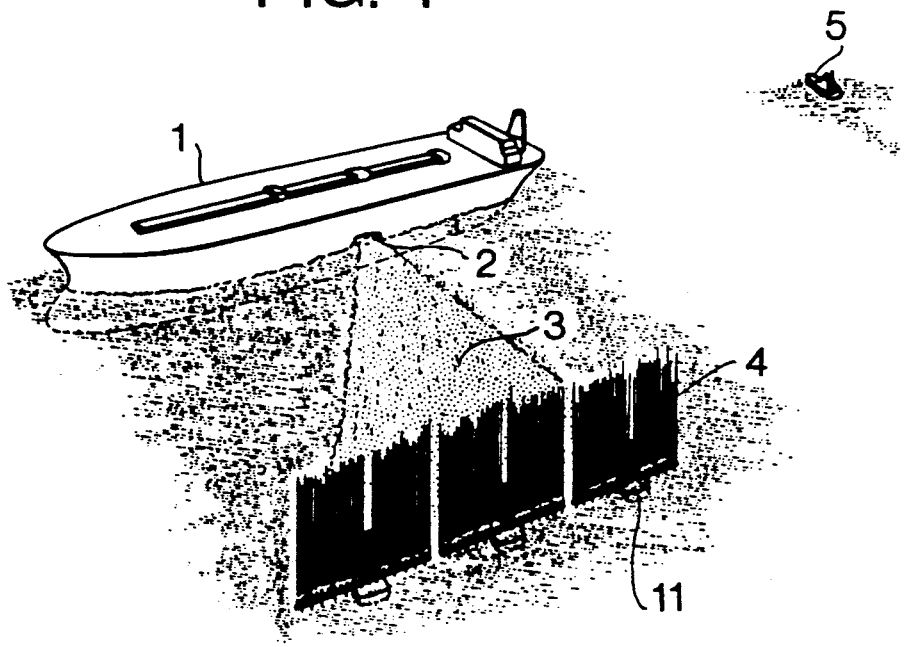
FIG. 1 is a perspective view showing a first embodiment of an accident prevention water curtain forming apparatus according to the present invention.

Now preferred embodiments of the present invention will be described with reference to the accompanying drawings.

The aquatic disaster prevention water curtain forming apparatus ("ADPWCFA" hereinafter) is positioned in a manner such that it is substantially perpendicular to the wind direction of the lee with a predetermined distance from a leaking part of a ship 1. The ADPWCFA includes three water curtain ships 11 so aligned as to form a set of water curtains 4 of, for example, a length for 160 meters and a height of 20 meters, which are of course determined in accordance with the width of a leaking gas 3.

Figure 2:
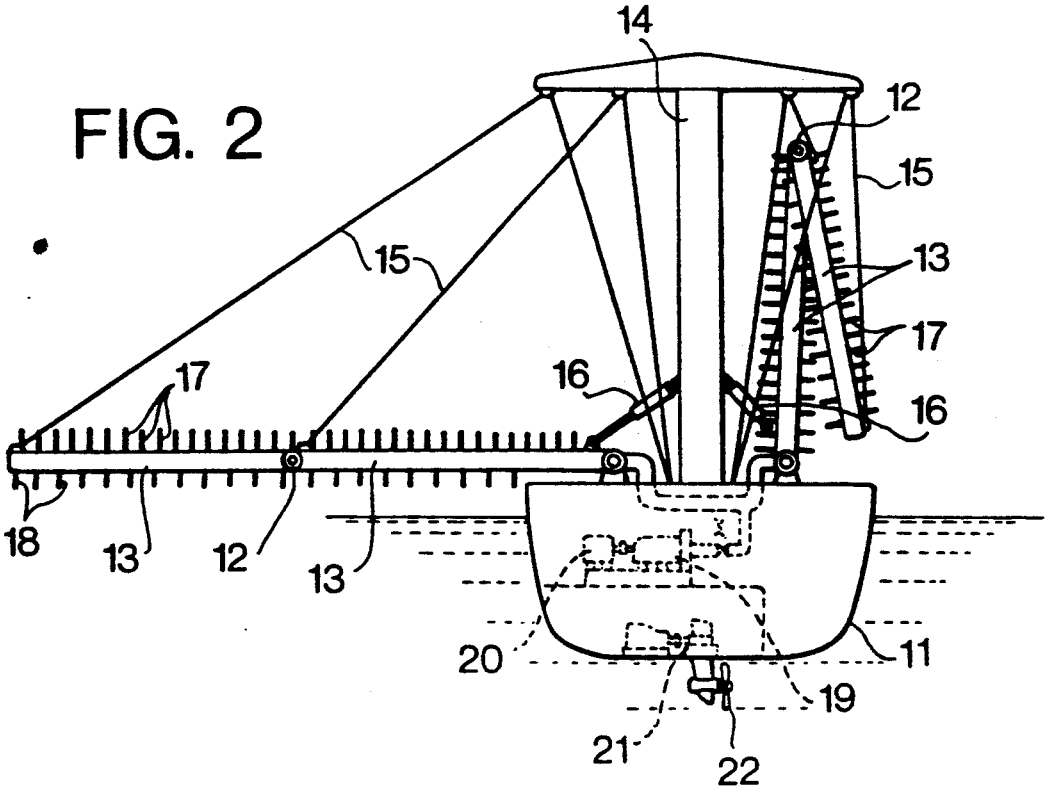
FIG. 2 is a front view showing expansion and folding of pipe members on a ship equipped with the accident prevention water curtain forming apparatus.

Referring to FIG. 2, the water curtain ship 11 is of an explosion-proof and gas-proof closed type, may have a propeller device (not shown) for self-travel, or may be towed by another boat.

The water curtain vessel 11 has a pair of water curtain pipes 13 which are rotatably attached to both sides of the ship through rotatable joints 12. The water curtain pipes 13 are adapted to be folded in two in a vertical plane. The water curtain pipes 13 are held by a pole 14 standing on a deck of the ship 11 through tow wires 15. These wires 15 are adapted to assist the folding operation of the water curtain pipes 13. A pair of fluid pressure cylinders 16 are installed between the pole 14 and the water curtain pipes 13. Extension and contraction of a cylinder rod folds and expands the water curtain pipes 13. If necessary, a fluid pressure cylinder is fixed between the water curtain pipes 13.

There are a number of water curtain nozzles 17 at the regular intervals on the upper portion of the water curtain pipes 13 as they are expanded right and left horizontally, so that a supply of pressurized water to the pipes 13 makes water curtains 4 of, for example, about 20 meters in height. Also, there are a plurality of supplemental water curtain nozzles 18 on the lower portion of the pipes 13 in order to form water curtains in the spaces between the nozzles 18 and the sea surface.

A water pump 19 is boarded on the water curtain ship 11 so as to supply water under pressure to the water curtain pipes 13. The water pump 19 is driven by a motor 20 which is energized by a battery boarded on the water curtain ship 11 or electricity supplied thereto through a cable from an assistant ship 5.

One or two thrusters 21 are mounted at the bottom of the water curtain ship 11 in order to move the ship according to the flowing gas changed by various meteorological conditions, such as wind direction and tidal current. The thruster 21 has a screw propeller 22 rotatable about a horizontal shaft connected thereto. The thruster 21 can rotate a vertical shaft extending from the horizontal shaft about its center axis, thereby changing the direction of the screw propeller 22. Therefore, the water curtain ship 11 can move in any direction. The energy source for the thruster may, similar to the case of the water pump 19, be a battery inside the water curtain ship 11 or electricity supplied from the assistant ship 5.

When an accident occurs in the ship 1, the water curtain ship 11 travels to the place of disaster. The ship 1 may be towed by the assistant vessel 5 or move by itself. During travelling of the water curtain ship 11, the water curtain pipes 13 are bent and folded at the rotary joints 12 upwardly, and the wires 15 are wound by a winch (not shown) as shown in the right half of FIG. 2.

After the water curtain ship 11 travels to the site of a disaster, the water curtain pipes 13 are extended horizontally right and left and suspended by the wire 15, keeping them horizontal as shown in the left half of FIG. 2. Then, the thruster 21 of the water curtain ship 11 is driven and controlled by a remote drive system of the assistant ship 5 so as to place the water curtain pipes 13 at a position of predetermined distance from the leaking portion 2 of the ship 1 on the lee perpendicular to the wind direction. Then, the water pump 19 starts the water curtain 4 of, for example, about 20 meters in height above the water curtain pipe 13 whereas the pump 19 forms other water curtains by the supplementary water curtain nozzles 18 below the pipes 13.

Thus, the water curtain 4 prevents the leaking gas 3 from diffusing horizontally on the lee while promoting an upward diffusion of the gas. As a result, if the leakage is low-temperature gas, the freezing of the water is limited to a small area, since the water curtain helps the leakage to vaporize. If the leakage is flammable gas, an explosion and fire are prevented. If the gas is poisonous, deterioration of the environment is prevented. If the gas is very hot, its radiant heat is absorbed.

When the flowing direction of the leakage changes due to meteorological conditions such as a change in tidal current direction or wind direction, the thruster 21 of the water curtain ship 11 is controlled so as to move the ship 11 to the position perpendicular to the wind direction by a predetermined distance from the leaking portion 2. The thruster 21 is automatically remote-controlled by the assistant boat 5. More specifically, the direction and the swing speed of the thruster 21 are adjusted on the basis of positions of the ship 1, the extending end of the water curtain pipes 13 on the water curtain ship 11, and the wind direction, which are detected by a radar, a radio range finder and a wind meter.

The water curtain pipe 13 can be easily readied by extending it by the wire 15 and the fluid pressure cylinder 16. The wire 15 and the cylinder 16 may also be remote-controlled.

In addition, it is easy to transport the water curtain forming apparatus to the disaster site, and the entire structure of the apparatus can be stored in a space of a size corresponding to that of the apparatus itself, economizing on the space of a building or piers.

In accordance with the embodiment mentioned above, each water curtain pipe 13 is folded in a vertical plane. However, it is also possible to fold the pipe 13 in a horizontal plane. In this case, the pipe is folded and put on the water curtain ship 11.

Moreover, the water curtain pipe 13 may have more than two segments. Such a pipe is useful, particularly when only one water curtain ship 11 is employed. Also, another mechanism may be employed other than the piston-cylinder system in expanding the water curtain pipe.

The present invention is not limited to a motor driving the thruster 21 and the water pump 19, and it is possible to use engines for the purpose. In this case, it is necessary to mount a fuel tank, as well as an air container and an oxygen container, and to assure a gas-proof characteristic by isolating them from the outside. In this manner, the fuel tank will not be a cause of a secondary explosion.

When the water curtain pipes 13 for making water curtains are secured at the place of the ship extending close to the sea surface, it is possible to omit the supplemental water curtain nozzles 18 from the pipes. The number of the water curtain ships 11 is not limited to three, and it is possible to determine the number at will.

It is natural to construct the disaster prevention water curtain forming apparatus of the present invention in a manner such that it travels over any aquatic surfaces such as a lake, a river or the sea.

Embodiment 2

Figure 3:
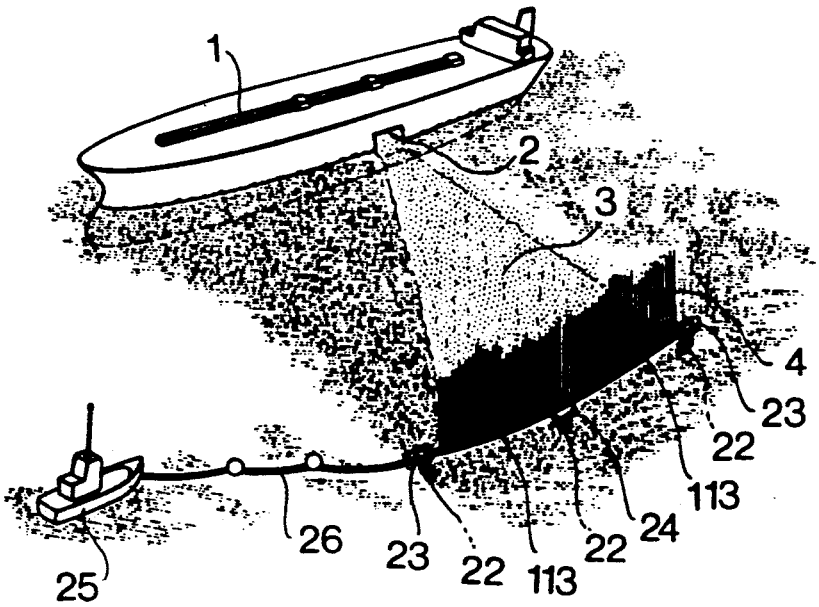
FIG. 3 is a perspective view showing a second embodiment of an accident prevention water curtain forming apparatus according to the present invention.
Figure 4:
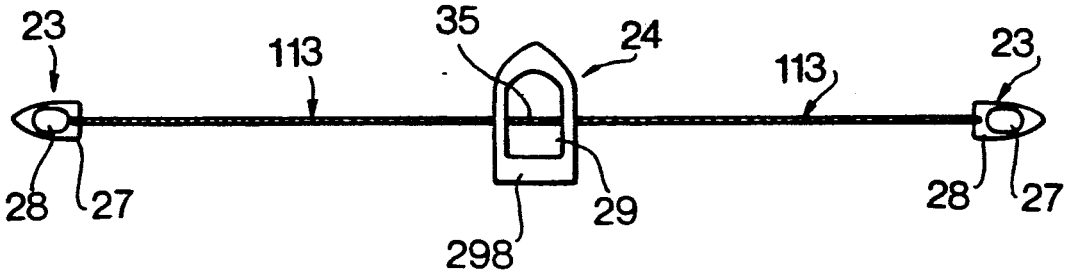
FIG. 4 is a top expanded view of the floatable members.

As shown in FIG. 3, the on-the-water water curtain forming apparatus has two end pontoons 23 and a central pontoon 24. The end pontoons 23 are spaced apart from each other by a distance longer than the width of the spill 3. The end and central pontoons 23 and 24 are connected to each other via a water curtain pipe 113. The water curtain pipe 113 is extended when the water curtain 4 is to be created as shown in FIG. 4, and otherwise folded as shown in FIG. 6. The pontoons 23 and 24 are transported to the site of a disaster as a single large pontoon in tow of another vessel, such as a tug boat 25 with the water curtain pipe 113 being folded as just described. The pontoons 23 and 24 respectively possess thrusters 21 for travelling on the sea and changing the position at which the water curtain 4 is built. Referring to FIG. 5, the central pontoon 24 is provided with a water pump 19 mounted thereon for supplying pressurized water to the water curtain pipe 113. The water pump 19 is driven by electricity supplied from the tugboat 25 through a cable 26 so as to send water to both end pontoons.

As shown in FIGS. 4 to 7, the end pontoon 23 comprises a submerged portion 27 having a blow-like sharp end and an exposed portion 28 of a generally cylindrical shape, constructed integrally with the bow-like portion 27. Due to this construction, little wave effect is exerted on the end pontoon 23, i.e., the pontoon 23 is rolled less by the wave. If the pontoon carries flammable gas, the hull of the pontoon may be made out of gas-proof material so that the gas therein is not ignited.

The central pontoon 24 is generally twice as wide as the end pontoon 23 and comprises a bow-like submerged portion 298 and a rectangular-shaped exposed portion 29. The central pontoon 24 possesses a submerged portion 298 which is constructed in a manner such that it reduces roll or pitch of the central pontoon 24. The on-the-water portion 29 of the central pontoon is continuously built on the submerged portion 298.

These two end pontoons 23 and central pontoon 24 respectively have the thrusters 21 mounted thereon. The central pontoon 24 has a water pump 19 for sending water to the water curtain pipes 113. The water curtain pipes 113 are connected between the end pontoons 23 and the central pontoon 24. The pipes can be expanded to about 50 m which will be longer than the estimated width of the leakage. The water curtain pipes 113 comprise pipe segments 30 made of light material such as FRP (fiber reinforced plastic) and connected by a plurality of U-shaped rotary joints 31. In detail, right angle elbows 32 bending from horizontal to vertical are connected to the ends of the horizontally-lying pipe segments 30, and the U-shaped members 31 provided with rotary joints at the ends thereof are connected between the elbows. Thus, each two horizontally extending pipe segments 30 can rotate about one vertical axis defined by the U-shaped member 31 so as to be folded. Due to this construction, roll and pitch of the water curtain pipe 113 is restrained.

The end of the water curtain pipe 113 connected to the end pontoon 23 is closed, and the opposite end thereof is connected to a discharge pipe of the water pump 19 in the central pontoon 24.

A float 33 filled with foam urethane and the like is attached to the upper portion of pipe segments 30 of the water curtain pipe 113, such that the water curtain pipe 113 floats in the water with the aid of the pontoons 23 and 24.

There are a plurality of water curtain nozzles 17 extending upwardly at predetermined intervals from the water curtain pipes 113, and these nozzles 17 eject water upwardly to a height of about 20 m to form a water curtain 4.

On the way to the disaster site, the water curtain pipes 113 are kept folded with the U-shaped rotary joints 31 being pivots as shown in FIG. 6. The folded pipes 113 are maintained as they are due to floats 34 which connect the submerged portions of the end pontoons 23 and the central pontoon 24 as shown in FIG. 7. The floats 34 are removed at the disaster site.

The central pontoon 24 has a fixed water curtain pipe 35 lying transversely thereon, as shown in FIGS. 4 and 6, in a manner such that it connects the right and left water curtain pipes 113 as a single pipe.

As shown in FIGS. 5 and 6, during towing and storage of the aquatic water curtain forming apparatus, the water curtain pipes 113 of the apparatus are folded, and both end pontoons 23 are arranged side by side at the rear of the central pontoon 24. As mentioned above, the central pontoon 24 and the two end pontoons 23 are connected by the connecting float 34 to each other, making a single ship.

The single combined ship is towed, taking the central pontoon 24 in the lead by the tugboat to the disaster site. There, the connecting float 34 connecting both the pontoons 23 and 24 is removed. The thrusters 21 installed in the end portions 23 and the central pontoon 24 are driven to separate the end pontoons from the central pontoon, extending the water curtain pipes 113 in a line and in a manner such that the pipes 113 can form a water curtain which intercepts the spill 3 from the disaster ship 1. Then the water pump 19 is energized to reject water through the water curtain nozzles 17, forming a water curtain 4 of a height of about 20 m and a length of about 160 m.

Thusly formed, water curtain 4 intercepts the gas flow and prevents it from dispersing on the lee along the horizontal direction on the sea surface, whereas the water curtain 4 promotes the upward dispersion of the gas. Therefore, the leak does not spread to a great extent, and explosion, fire and environmental damage due to the leak are minimized.

In some cases, it may be satisfactory to build the water curtain 4 at a fixed distance from the point of the spill. However, in the ocean, for instance, it is necessary to change the positions of the water curtain 4 since the direction of the gas flow varies with direction of wind and tidal current.

In order to move the water curtain 4 or change its direction during monitoring of the tugboat 24, the thrusters 21 of the end pontoons and the central pontoon are remotely controlled.

The positions of the disaster ship 1 and the end pontoons 23 are detected by a radio range finder or the like, wind direction is measured by a wind meter, and each of the thrusters 21 is automatically controlled on the basis of the signals of the detection and measurement in order to place the water curtain 4 in a posture perpendicular to the wind direction and at a position apart from the leaking portion 2 of the ship on the lee by a proper distance. It is possible to advance in particular the end pontoons toward the leaking portion with the center pontoon held stationary so as to form a V-shaped curtain which encloses or confines the leaking as.

Although one central pontoon 24 is employed in this embodiment, it is possible to increase the number of the central pontoons to change the extending line of the water curtain 4 from a line to a curve or any of various shapes. When a number of the central or intermediate pontoons respectively having submerged portions is increased, shaking or swaying of the water curtain pipes 113 is substantially reduced.

Although electricity is supplied from the tugboat to the pontoons through a cable 26 in this embodiment, it is possible to take batteries, air tanks and fuel tanks necessary for generators of engines on the pontoons which are constructed of gas-proof materials and are towed on the sea to the disaster site by a tugboat.

It is possible to construct the water curtain pipes 113 using other than FRP pipes and float members described above, e.g., using fabric hoses and air hoses which serve as the float members. Other material and constructions may also be employed as long as they give the necessary flexibility and foldability.

The pontoons may be provided with propeller devices which eliminate the need for the tugboat 25.

Embodiment 3

Figure 8:
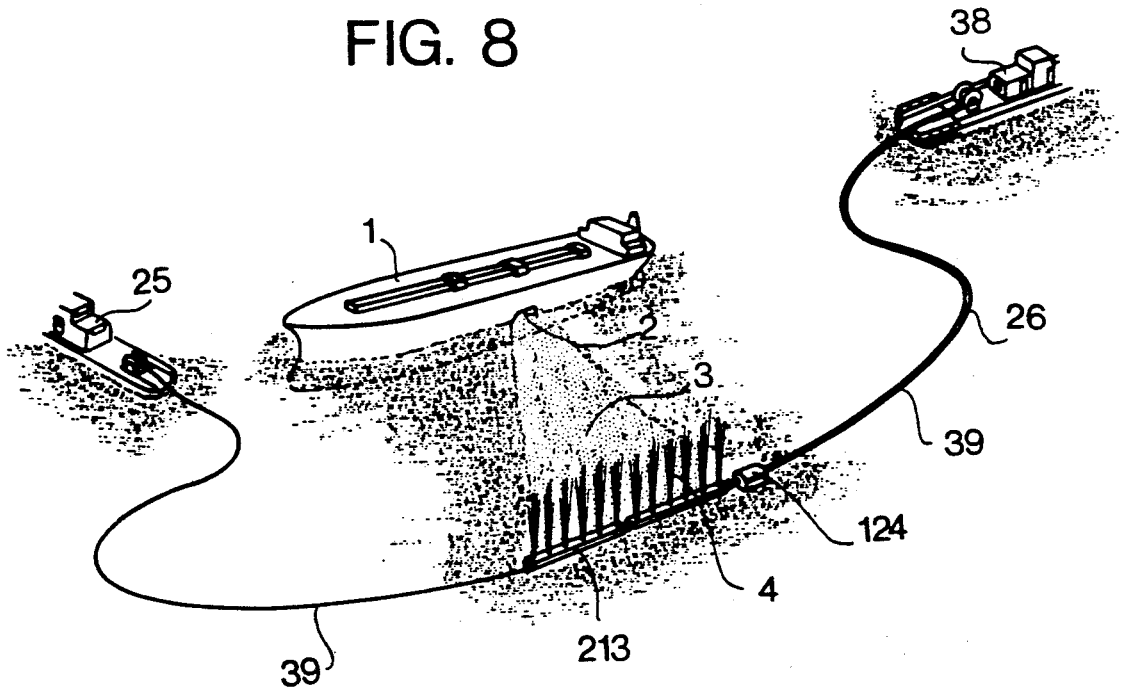
FIG. 8 illustrates a third embodiment of the present invention.
Figure 9:
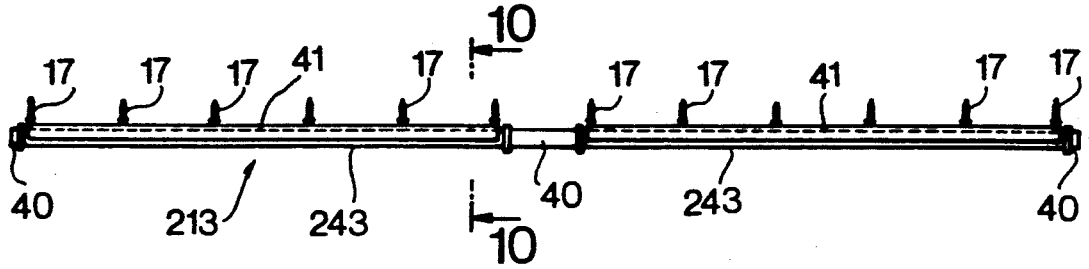
FIG. 9 illustrates a pipe member and a floatable member as they are connected to each other.

Referring to FIG. 8, a water curtain pipe 213 is adapted to float on the sea and located near the accident ship 1 which is sufficient to stop the spill 3 from the leaking part 2 of the ship 1. The ADPWCFA of this particular embodiment is adapted to be transported on an exclusive-use vessel 38 until arrival at the accident site. During the transportation, the water curtain pipe 213 is folded. The water curtain pipe 213 accompanies a gas-proof pontoon 124 connected to one end thereof. The pontoon 124 has a water pump therein (not shown) for supplying pressurized water so as to form a water curtain 4. The water pump is driven by electricity supplied from another boat 38 via a cable 26. The water curtain pipe 213 is connected to the vessel 38 at one end and to a tugboat 25 at the other end so that the position of the water curtain pipe 213 changes as those vessels change their positions.

As shown in FIGS. 7 and 10, the water curtain pipe 213 includes a plurality of pipe segments 243 that are connected to each other by flexible hoses 40 which may be fabric hoses. The pipe segments 243 are about 160 meters in length as they are connected to each other and made from FRP in order to make them light in weight. In addition, each pipe segment 243 is provided with float 41 which is rectangular in section. The float 41 is filled with urethane foam and extends along the longitudinal direction of the pipe segment 243, covering substantially the entire top portion of the pipe segment 243. The float 41 also extends in the radial direction of the pipe segment 243, so that the water curtain pipe 213 floats stably on the water. A number of water curtain nozzles 17 are installed at regular intervals along the top of each pipe segment 243. Those nozzles 17 extend upward, penetrating the float 41 from the pipe segments 243.

When the water curtain pipe 213 is used to intercept the gas 3 from the leaking portion 2 of the ship 1 or to promote upward dispersion of the gas, the pipe 213 is extended linearly. During a rapid travel of the ADPWCFA toward the site of the disaster, the water curtain pipe 213 is folded through the flexible hoses 49, such as fabric hoses, and arranged side by side or in parallel in the exclusive-use vessel 38 as shown in FIGS. 11 and 12.

In order to mount the ADPWCFA on-board the exclusive-use vessel 38, the cable 26 and the wires 39 are wound around a winding drum 42, the pontoon 124 having the water pump connected to one end of the water curtain pipe 213 is placed inside of the vessel, and the folded water curtain pipe 213 is placed near the stern of the vessel 38. In forming the water curtain on the sea, first the other end of the water curtain pipe 213 is drawn out of the vessel on the water surface by a tugboat 25.

After that, as shown in FIG. 8, the water curtain pipe 213 is placed perpendicular to the wind direction on the lee at a position spaced from the leaking portion 2 of the ship 1 at a proper distance by means of the boat 25 and the vessel 38 in order to intercept the gas 3. As the pressurized water is sent from the water pump 11 to the water curtain pipe 213, the water is ejected through the water curtain nozzles 17, thereby forming a water curtain 4 of a height of about 20 m and a length of about 160 m.

As a result, the dispersion of the leakage 3 on the lee in the horizontal direction along the water surface is blocked while upward dispersion of the leakage is promoted. It has been confirmed by a test carried out on a land-based installation that a water curtain of 20 m in height had a sufficient dispersive effect. The danger area in which an explosion and fire might occur due to the leaking flammable gas is reduced, and peril to the environment due to a poisonous spill is also reduced.

Embodiment 4

Figure 13:
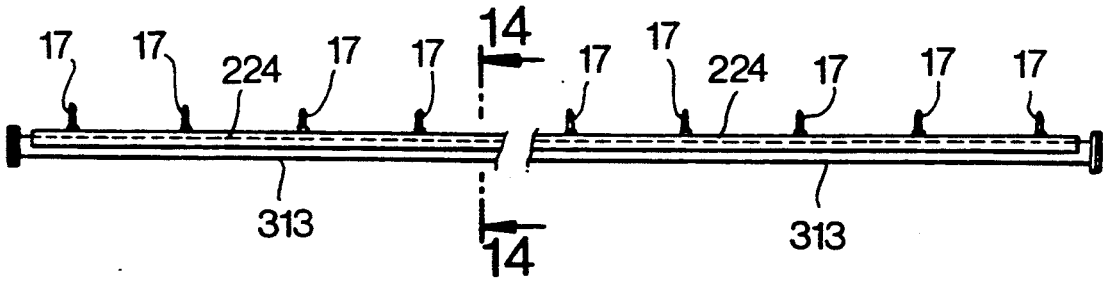
FIG. 13 is a partly enlarged side view depicting a fourth embodiment of the present invention.
Figure 14:
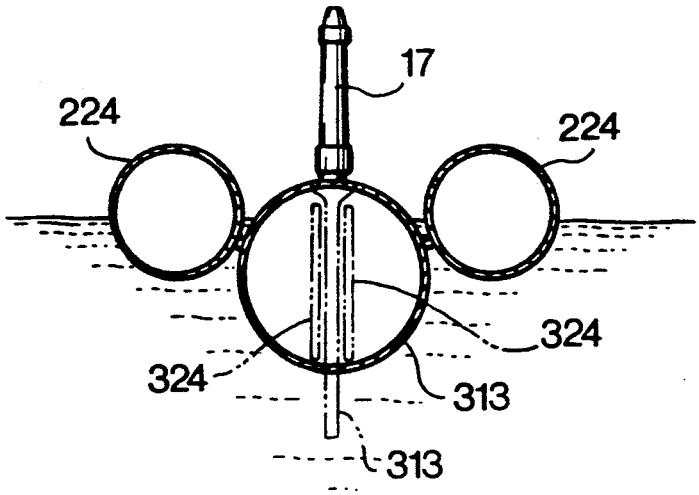
FIG. 14 is a sectional view taken along the line XIV—XIV of FIG. 13.

Referring to FIGS. 13 and 14, the water curtain pipe 313 of the ADPWCFA is made from a single flexible fabric hose. Buoyant members 224, such as fabric hoses, are attached to both lateral sides of the water curtain pipe 313. The buoyant members 224 are adapted to be inflatable by air supplied from an air compresser or air tanks on a pontoon (FIG. 1).

A plurality of water curtain nozzles 17 are installed on the top of the water curtain pipe 131 at predetermined intervals. Those nozzles are adapted to inject water upward so as to create a water curtain standing on the water surface.

The water curtain pipe 313 is put on a boat 38 when it is carried near an accident area. When the water curtain pipe 313 is on the boat 38, it is flattened as indicated by the double-dotted line 324 in FIG. 14 and folded or wound by a drum after air and water inside the pipe 313 are expelled.

The water curtain pipe 313 is unloaded onto the water surface from the exclusive-use vessel 38, after transportation to the target site, as in the case of the previous embodiments. Air is then sent to the buoyant members 224, and the water curtain pipe 313 is moved to a proper position near the accident spot. The water curtain 4 is formed by injecting through the nozzles 17 pressurized water supplied by the water pump.

Because the water curtain pipe 313 and the float 224 are both flexible, and the combination of these are also flexible, loading and unloading of the pipe on the vessel is easy, and the weight of the pipe is light which facilitates handling.

According to this embodiment, the vessel 38 and the tugboat 25 are used as a mover for the ADPWCFA. However, the vessel 38 can be replaced by an ordinary boat, and two boats are enough to extend the water curtain pipe. Two pontoons 224 respectively provided with the thrusters 21 may be employed as the moving means.

The ADPWCFA is carried on a transportation vessel, and the vessel is carried on a mother vessel such as a large gas tanker. When an accident occurs offshore, the mother vessel moves near the accident site, and then the transportation vessel is lowered onto the water and travels to a desired position. The transportation vessel may be a pontoon provided with a thruster or other type of boat.

The water may be supplied to the water curtain pipe not only by the water pipe 19 mounted on the pontoon 224, but also by a small vessel such as a tugboat 25 and an exclusive-use vessel 38 or mother ship.

Other than FRP and fabric material, metal may be used in making the water curtain pipe 313. Any material is satisfactory as long as it is anti-corrosive and not affected by salt of the sea.

Embodiment 5

Figure 15:
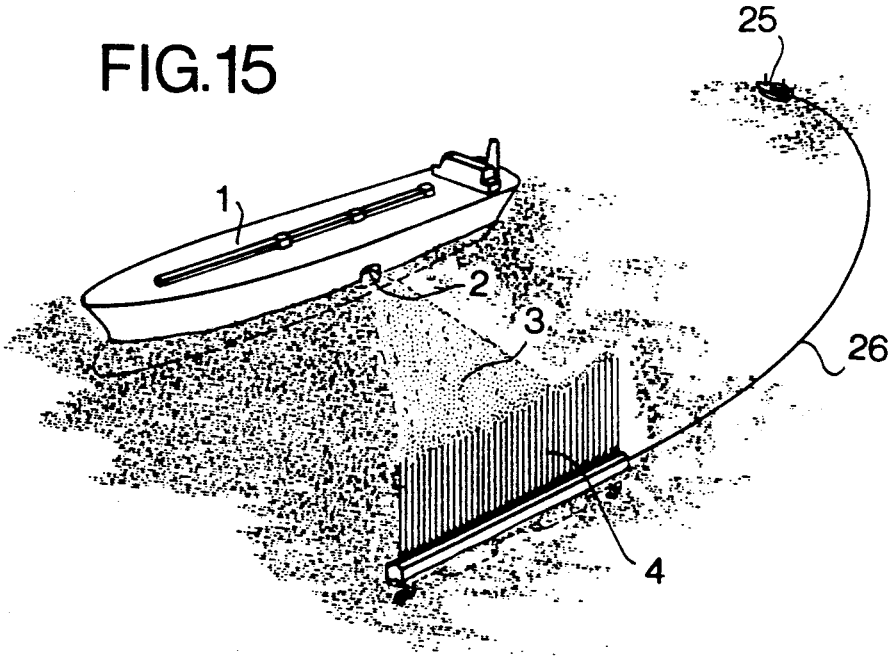
FIG. 15 shows a perspective view of a fifth embodiment of the present invention.

The ADPWCFA of this embodiment is adapted to be installed, as shown in FIG. 15, perpendicularly relative to the direction of flow of the gas 3 at the position on the lee apart from the leaking part 2 of the accident ship 1, so as to create a water curtain 4 of, for instance, 160 m in width and 20 m in height. The height and the width of the water curtain 4 is of course determined in accordance with the size of the spreading gas 2.

Figure 16:
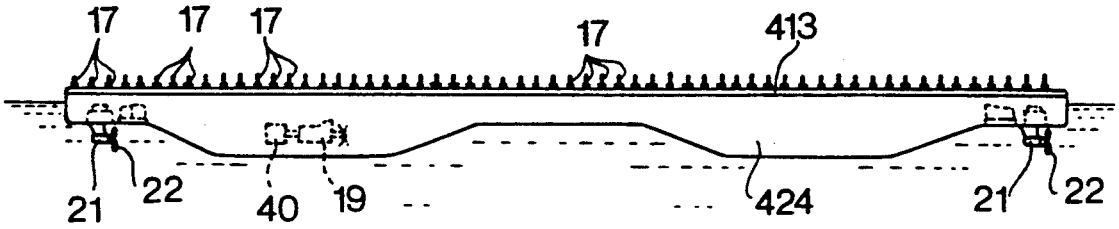
FIG. 16 illustrates the floatable members.

Referring to FIG. 16, the ADPWCFA possesses a float 242. The float 242 is about 160 m in length, has a gas-proof structure, and exposes part of the top thereof above the water surface.

On the longitudinal top of the float 424, a water curtain pipe 413 is installed. There are plural water curtain nozzles 17 on the water curtain pipe 413 at predetermined intervals to eject water upward, forming a water curtain 4 of about 20 m in height. The water pump 19 for supplying compressed water to the water curtain pipe 413 is mounted in the float 424, which pump is driven by a motor 49. Electricity for the motor 40 is supplied from the assistant boat 25 via a cable 26, as shown in FIG. 15.

The thrusters 21 are mounted on both ends of the float 424 so that the float can move without outside help. Like the water pump 19, the thrusters are driven by electricity supplied from the assistant boat 25 via the cable 26.

When an accident occurs in the ship 1, the ADPWCFA is moved to the site by means of the assistant boat 25 with the thrusters 21 being driven by electricity supplied via the cable 26. After the water curtain pipe 413 is located at a proper position, the water pump 19 is driven by the motor 40 whereby water is injected through the water curtain pipe 413 and the water curtain nozzles 17, forming the water curtain 4 at a position perpendicular to the wind direction on the lee.

As a result, the water curtain intercepts the horizontal dispersion of the spill while promoting the upward dispersion of the gas. Therefore, the spill does not pose grave risk to the marine life and does not become the cause of an explosion.

When the direction of the spill 3 changes due to the tidal current and wind direction, the float 424 is moved to another position in a manner such that the water curtain 4 always faces the spill perpendicularly and apart from the ship 1 by a proper distance. The float 424 is actually moved by the thrusters 21 which are mounted thereon and is remotely controlled from the assistant boat 5. The thrusters 21 may be automatically controlled upon detection of the positions of the ship 1 and the float 424 by means of a radar or a radio range finder and detection of the wind direction by means of a wind meter.

The ADPWCFA can easily create a disaster prevention water curtain by towing the float 424 and establishing the water curtain 4 near the disaster area. Since the ADPWCFA has a gas-proof structure, it does not become an ignition source even if it is located in the stream of flammable gas.

Embodiment 6

Figure 17:
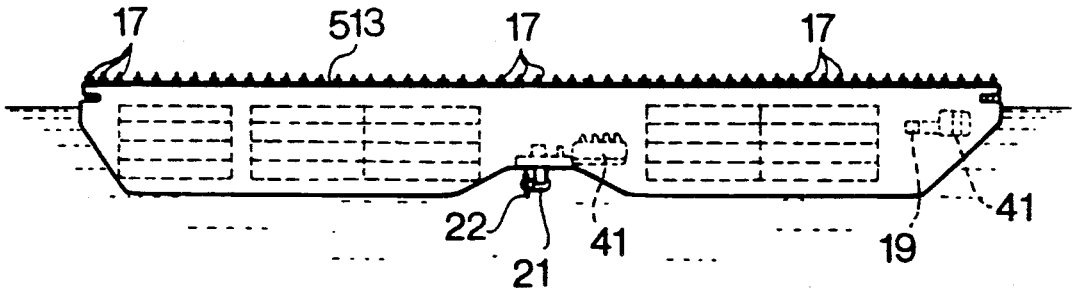
FIG. 17 illustrates a sixth embodiment according to the present invention.
Figure 18:
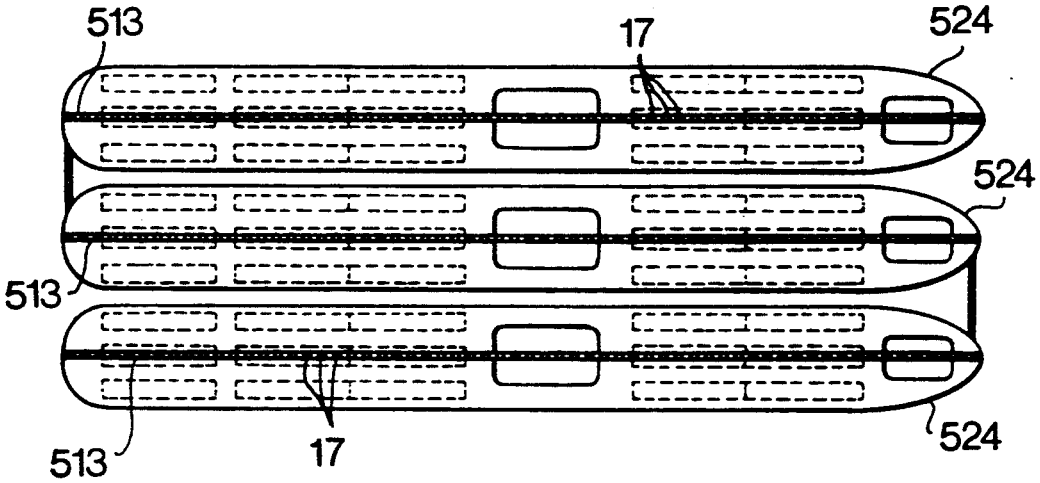
FIG. 18 is a top view showing the folded floatable members.
Figure 19:
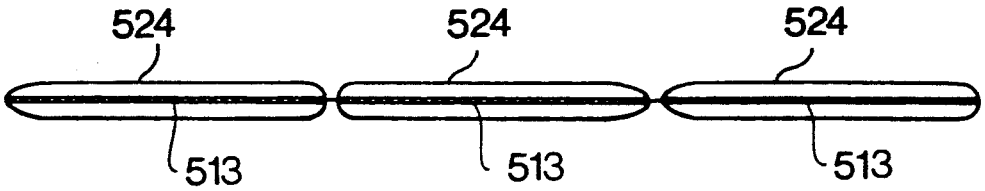
FIG. 19 is a top view showing the unfolded floatable members.

Referring now to FIGS. 17 to 19, the ADPWCFA has three floats 524 which are easy to store and save storage space. Three pipes 513 are respectively mounted on the floats. With the aid of these floats, the pipes 513 can be arranged in a row, so as to form a single water curtain.

The floats 524 respectively have water curtain pipes 513 provided with a number of water curtain nozzles 17 installed on the pipes at predetermined intervals.

It is noted that the floats 424 are respectively of a gas-proof construction and have water pumps 19 connected to the water curtain pipe 313. The thruster 21 is mounted at the central portion of each float 524 in order to change the position and direction of the water curtain 4.

The float has an engine 41 for driving the water pump 19, the thruster 21, a fuel tank and an air tank or container (not shown). These tanks and containers are kept in a gas-proof and closed condition while the engine is driving the thruster.

During waiting and towing, such an ADPWCFA has a length of only one-third of its entire normal length since three floats are folded as shown in FIG. 18. After arriving at the accident site, the floats travel to the proper position by themselves using the thrusters and are aligned, as illustrated in FIG. 19, in a manner such that the line defined by the extended floats is perpendicular to the direction of the spill 3.

Thereafter, the engine 41 is energized to drive the water pump 19 to supply compressed water to the water curtain nozzles 17 through the water curtain pipes 313, thereby forming a water curtain 4 of, for example, 20 m in height.

When the spreading direction of the leakage changes, the water curtain forming floats 324 automatically change their positions. The thruster of the float 324 is remotely controlled on the basis of detection of the wind direction and the float position.

Since a large portion of the float 524 of the ADPWCFA is submerged as shown in FIG. 17, the roll and pitch of the ADPWCFA is prevented, thereby stabilizing the water curtain.

Three sets of the floats 524 and pipes 513 need not always be utilized. When the accident ship 1 spews just small amounts of spill 3, only one of the floats and pipes may be enough.

Although the floats 524 are towed by the assistant boat to the site of the disaster, a propeller device may be mounted on the float which eliminates the need for the assistant boat.

The types of the pressurized water supply devices and transportation devices are not limited to those mentioned in the foregoing embodiments. In the case where these devices are driven by motors, generators may be driven by batteries and engines mounted on the floats 524, rather than by outside power source.

Also, more or less floats 524 and pipes 513 may be employed in accordance with the size of the spill or other conditions.

We claim:

1. An aquatic disaster prevention water curtain forming apparatus comprising:

at least one aquatic body floatable on a body of water near an object at which a disaster is occurring;

water curtain forming means for ejecting water above the surface of the body of water to form a vertical curtain of water separates from and disposed above the surface of the body of water, the curtain extending substantially above the water surface with a height sufficient to intercept and disperse gas flowing from said object above the water surface; and pressurized water supply means for continuously supplying pressurized water to said water curtain forming means in order to form the water curtain.

2. An aquatic disaster prevention water curtain forming apparatus according to claim 1, wherein said water curtain forming means includes pipe members extending from the aquatic body above the water surface, and nozzles for continuously ejecting pressurized water supplied to said pipe members from said pressurized water supply means in order to intercept and disperse gas flowing from said object, said nozzles being installed on said pipe members at spaced apart intervals.

3. An aquatic disaster prevention water curtain forming apparatus according to claim 2, wherein said pipe members include rotary joints enabling the pipe members to be folded, and said rotary joints being installed in a manner such that said pipe members may be folded in a plane perpendicular to the longitudinal direction of the pipe members.

4. An aquatic disaster prevention water curtain forming apparatus according to claim 1, wherein said aquatic body has moving means installed at a submerged portion thereof for moving the aquatic body to a desired position near a gas leaking portion of said object in accordance with a change of the leaking gas.

5. An aquatic disaster prevention water curtain forming apparatus according to claim 4, wherein said moving means includes a thruster provided with a screw propeller rotatable about a vertical axis for generating a stern stream.

6. An aquatic disaster prevention water curtain forming apparatus according to claim 1, wherein said aquatic body includes means for coupling said aquatic body with a towing vessel to allow said aquatic body to be towed.

7. An aquatic disaster prevention water curtain forming apparatus according to claim 2, wherein said pipe members are joined with each other in series by joint members and said aquatic body includes deck means, supporting members erected on said deck means and lines on the supporting members, said lines being connected to the joint members of the pipe members so as to make the pipe members foldable.

8. An aquatic disaster prevention water curtain forming apparatus according to claim 7, wherein the joint member is a flexible member and the pipe member is a nonflexible member.

9. An aquatic disaster prevention water curtain forming apparatus comprising:

at least one aquatic body floatable on a body of water near an object at which a disaster is occurring;

water curtain forming means for forming a curtain of water by ejecting water substantially perpendicular to the surface of the body of water in order to intercept and disperse gas flowing from said object; and, pressurized water supply means for continuously supplying pressurized water to said water curtain forming means in order to form the water curtain, said water curtain forming means including pipe members extending from the aquatic body above the water surface, and nozzles for continuously ejecting pressurized water supplied to said pipe members from said pressurized water supply means in order to intercept and disperse gas flowing from said object, said nozzles being installed on said pipe members at spaced apart intervals, said pipe members including rotary joints enabling the pipe members to be folded, said rotary joints being installed in a manner such that said pipe members may be folded in a plane perpendicular to the longitudinal direction of the pipe members, said aquatic body including deck means, supporting members erected on said deck means and lines on the supporting members, the ends of said lines being connected to the pipe members so as to make the pipe members foldable.

10. An aquatic disaster prevention water curtain forming apparatus according to claim 2, wherein said nozzles include a first group provided on an upper portion of said pipe and a second group provided on a lower portion of said pipe, such that said first group ejects water upwardly, and said second group ejects water downwardly.

11. An aquatic disaster prevention water curtain forming apparatus according to claim 1, wherein said water curtain forming means includes a plurality of vertically directed water ejecting nozzles mounted on said aquatic body at a location above the surface of the body of water.

* * * * *

UNITED STATES PATENT AND TRADEMARK OFFICE

CERTIFICATE OF CORRECTION

PATENT NO. : 5,145,280

DATED : September 8, 1992

INVENTOR(S) : Araki et al.

It is certified that error appears in the above-identified patent and that said Letters Patent is hereby corrected as shown below:

Column 12, line 36, change "separates" to --separate--.

Signed and Sealed this

Thirty-first Day of August, 1993

Bruce Lehman

*Attest:*

BRUCE LEHMAN

*Attesting Officer*

*Commissioner of Patents and Trademarks*